US007909618B2

(12) United States Patent
Zhu

(10) Patent No.: US 7,909,618 B2
(45) Date of Patent: Mar. 22, 2011

(54) BOARD TO BOARD CONNECTOR WITH AN OFFSET MOUNTING PROFILE

(75) Inventor: Yu Zhu, ShenZhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 147 days.

(21) Appl. No.: 12/317,532

(22) Filed: Dec. 26, 2008

(65) Prior Publication Data

US 2009/0163052 A1 Jun. 25, 2009

(30) Foreign Application Priority Data

Dec. 25, 2007 (CN) ..... 2007 2 0129680

(51) Int. Cl.
*H01R 12/00* (2006.01)

(52) U.S. Cl. ..... 439/74

(58) Field of Classification Search ..... 439/74, 439/862, 752, 23–26
See application file for complete search history.

(56) References Cited

U.S. PATENT DOCUMENTS

| | | | | |
|---|---|---|---|---|
| 7,128,613 | B1 * | 10/2006 | Lee et al. | 439/630 |
| 7,470,129 | B2 * | 12/2008 | Trout et al. | 439/74 |
| 7,572,157 | B2 * | 8/2009 | Zhu | 439/862 |
| 2005/0106910 | A1 * | 5/2005 | Chiu | 439/136 |
| 2008/0090437 | A1 * | 4/2008 | Huang et al. | 439/188 |

* cited by examiner

*Primary Examiner* — Edwin A. Leon
*Assistant Examiner* — Vanessa Girardi
(74) *Attorney, Agent, or Firm* — Wei Te Chung; Andrew C. Cheng; Ming Chieh Chang

(57) ABSTRACT

A board to board connector (1) includes an insulating housing (2) and a plurality of terminals (3) formed on said insulating housing (2), the connector (1) forms two mating faces (251, 252) relatively offset from each other inside of the insulating housing (2). Each terminal (3) has two elastic-ends, each end (31,32) protruding from the respective mating faces (251, 252). The board to board connector (1) receives a circuit board on the first mating face (251) and a circuit board on the second mating face (252). Because of this offset of the board to board connector (1) design, the two boards are arranged such that the total height of board mounting profile is reduced.

19 Claims, 5 Drawing Sheets

BOARD TO BOARD CONNECTOR WITH AN OFFSET MOUNTING PROFILE

BACKGROUND OF THE INVENTION

1. Field of the Invention

The present invention relates to a board to board electrical connector, and more particularly to a board to board electrical connector with low board mounting profile. The instant invention relates to the application Ser. No. 12/313,168, now U.S. Pat. No. 7,572,157, filed on Nov. 17, 2008 having the same inventor and the same assignee with the instant invention.

2. Description of Related Art

Board to board connector, which is widely used for interconnecting circuits between two parallel boards, has been asked for smaller size and lower board mounting profile.

U.S. Pat. No. 5,395,250 issued to Englert, Jr. et al on Mar. 7, 1995 discloses a board to board connector. According to Englert, Jr., said board to board connector 20 including a receptacle 22 and a plug 70, each having a housing 24,72 with respective arrays of improved contacts 44,92 secured therein, the contacts 44,92 being of thin metal set on edge in the housings 24,72 and including edge contact surfaces 50,98 projecting from the housings 24,72 in a common plane for soldering to the circuits. Upon mating of the receptacle 22 and plug 70, said board to board connector 20 can be resulted in low profile. While in this face to face board mounting, the distance between two parallel boards are limited by the height of housings 24, 72.

Hence, a board to board connector with low board mounting profile is highly desired to overcome the disadvantages of the related arts.

SUMMARY OF THE INVENTION

Accordingly, the object of the present invention is to provide a board to board connector with low board mounting profile.

In order to achieve the object set forth, a board to board connector comprising an insulating housing and a plurality of terminals formed on said insulating housing, said connector forms two offset mating faces in relative inside of the insulating housing, and each terminal forms two elastic-ends protruded from said mating faces, when assembling, the board to board connector can receive two circuit boards in the first mating face and the second mating face, because of this offset board to board connector design, the two boards can be lied spreadably, so that the total height of board mounting profile will be improved.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
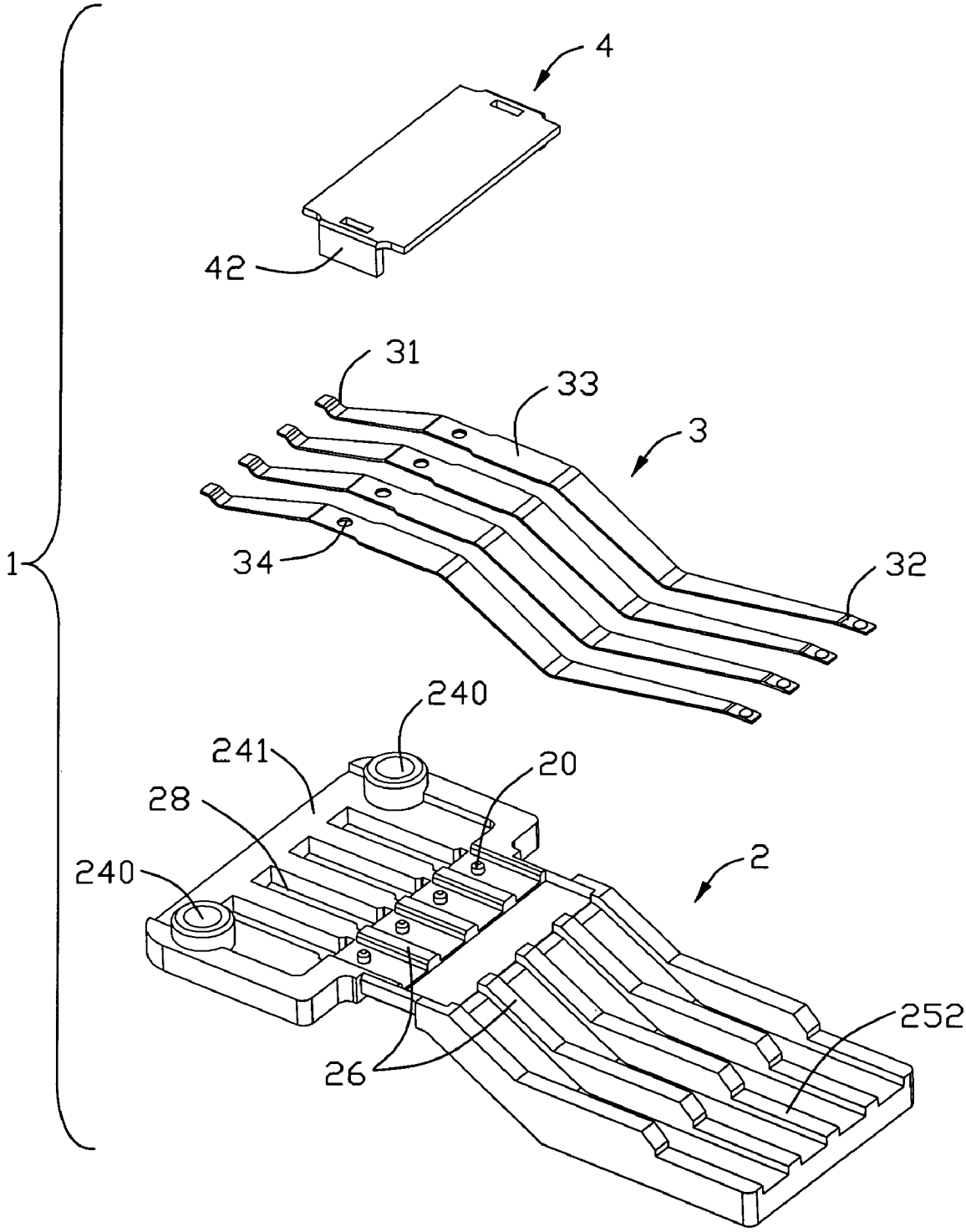
FIG. 1 is an exploded, perspective view of the board to board connector of an embodiment of the present invention.
Figure 2:
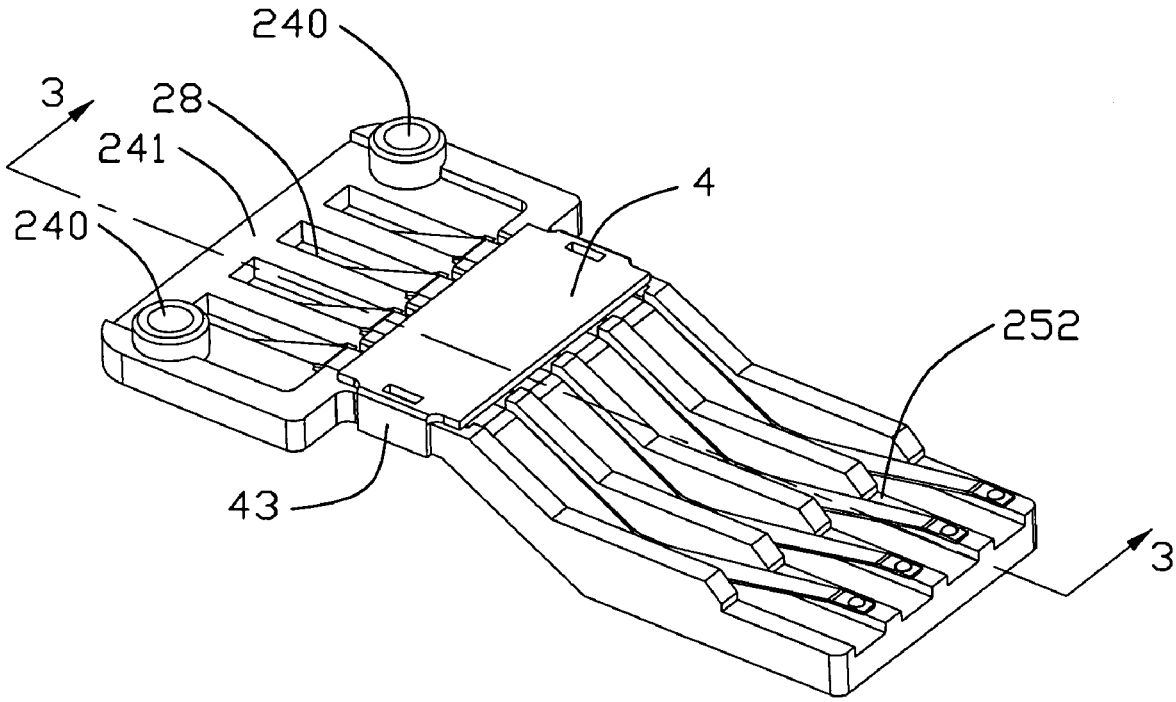
FIG. 2 is an assembled, perspective view of the board to board connector as shown in FIG. 1.

Referring to FIGS. 1-2, a board to board connector 1 comprises an insulating housing 2, a plurality of terminals 3 retained in said insulating housing 2 and a removable cover 4 that is engaged with the insulating housing 2.

Figure 4:
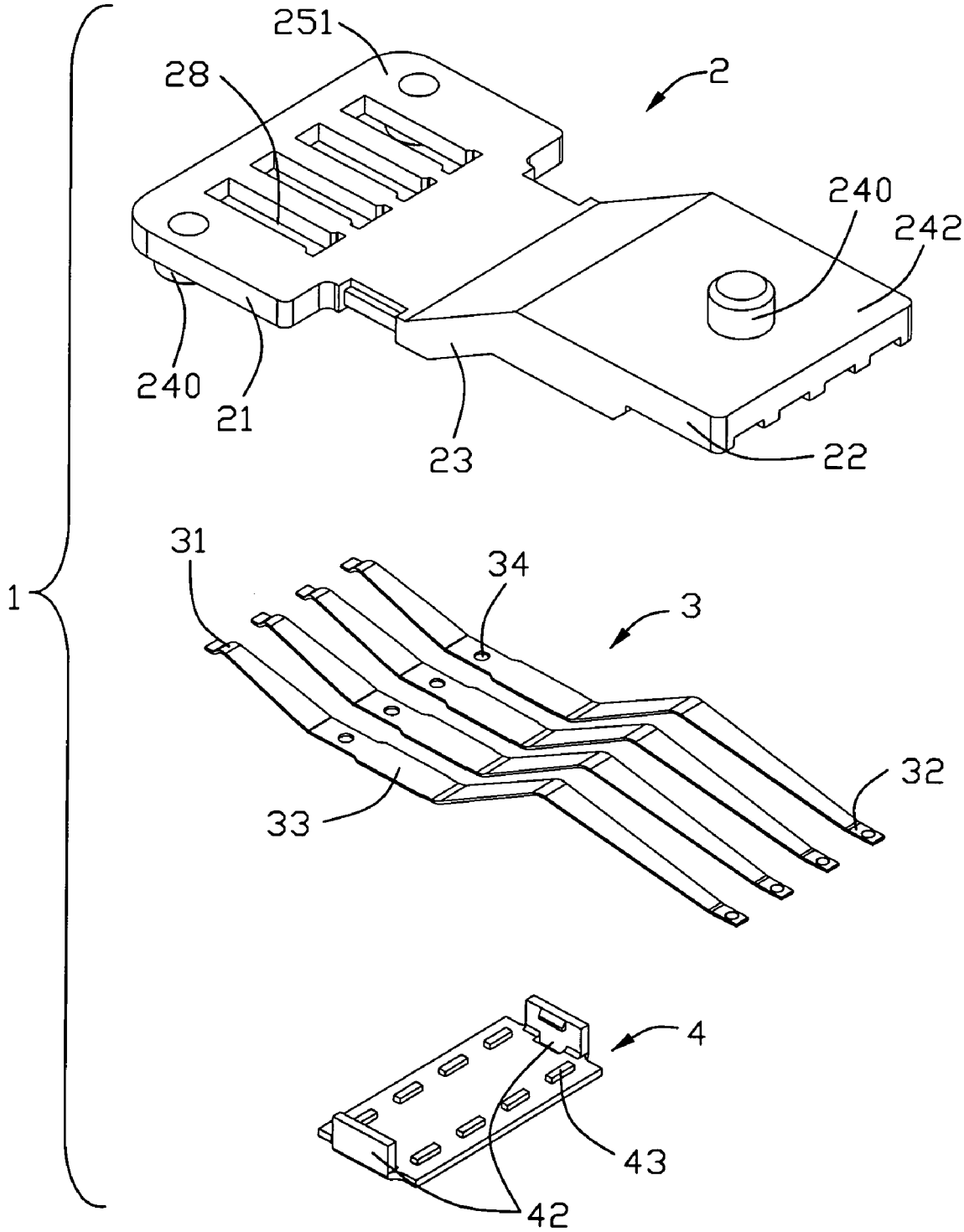
FIG. 4 is another exploded, perspective view of the board to board connector of an embodiment of the present invention.
Figure 5:
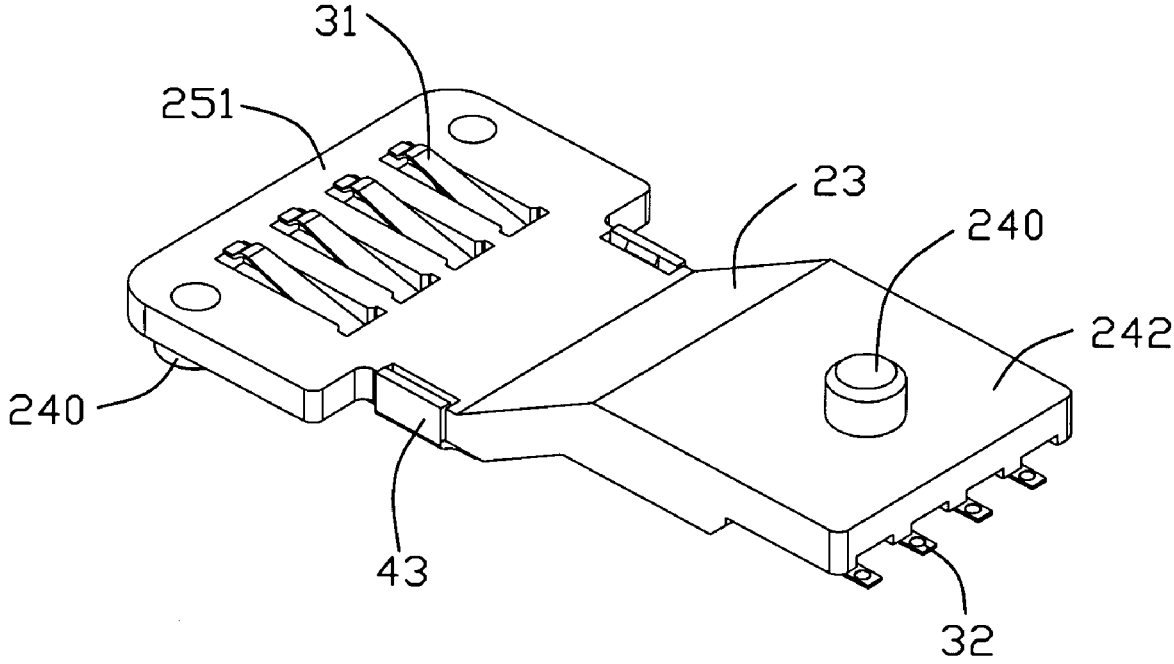
FIG. 5 is another exploded, perspective view of the board to board connector of an embodiment of the present invention.

Referring to FIGS. 1&4, said insulating housing 2 has a first mating portion or region 21 located in a first level, a second mating portion or region 22 located in a second level which is offset from the first level, and a medium or bending portion or a retention base 23 interconnecting the first mating portion 21 and the second mating portion 22 in the horizontal direction C. On the first mating portion 21, the face which is facing to the second level in a first vertical direction A is defined as a first mating face 251, and the other relative face is defined as a first base face or mounting face 241 with mounting posts 240 thereon. In the similar way, the face on the second mating portion 22 which is facing to the first level in a second vertical direction B is defined as a second mating face 252, and the other relative face is defined as a second base face 242. A plurality of slots 28 are formed on the first mating portion 21 and opening from said first base face 241 to the first mating face 251.

Still referring to FIGS. 1&4, Each of said terminals 3 in the shape of longitudinal sheet comprises a first elastic-end 31, a second elastic-end 32 and a engaging portion 33 set between the first elastic-end 31 and the second elastic-end 32, a opening 34 is further formed on said engaging portion 33.

Referring to FIGS. 1-5, Said board to board connector 1 further including a removable cover 4 with a pair of latches 42. When assembling, each of the terminals 3 is lined through the first mating portion 21, the bending portion 23 and the second mating portion 22. Said first elastic-end 31 is protruded on the first mating face 251 through the slots 28, and the second elastic-end 32 is protruded on the second mating face 251. A plurality of ribs 26 are formed on the insulating housing 2, and each of these ribs 26 is lined from the second mating portion 22 to the bending portion 23, which can help positioning the terminals 3 and enhancing the strength of insulating housing 2. Some protrusions 20 are formed on the insulating housing 2 to provide location for corresponding opening 34 on the terminals 3. Then said cover 4 is attached to the insulating housing 2 to help engaging the terminals 3, some press portions 43 are further formed on the cover 4 to hold the terminals 3.

Figure 3:
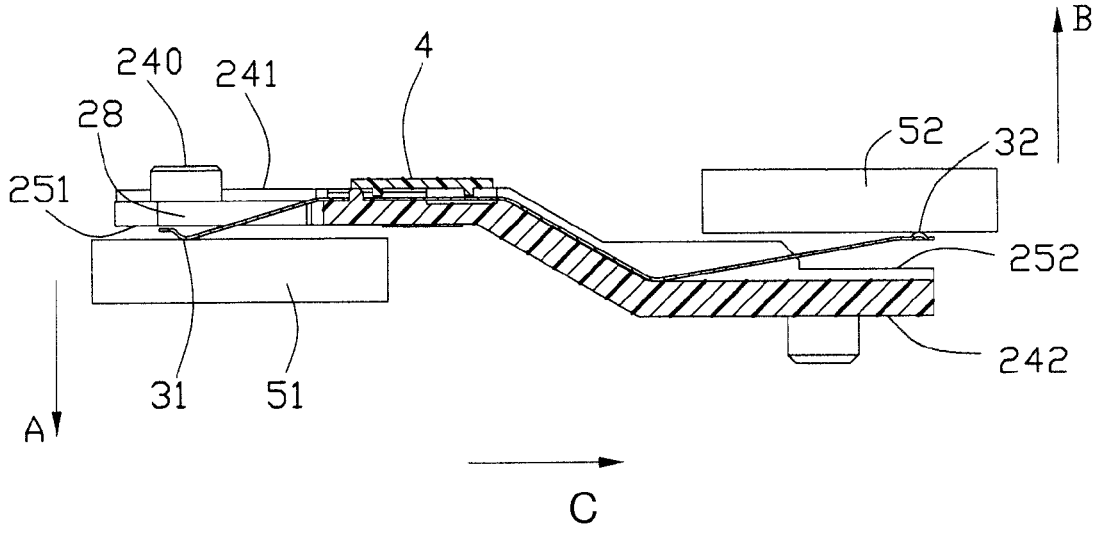
FIG. 3 is a cross-section view taken along line 3-3 of FIG. 2 with circuit boards mounted.

Referring to FIG. 3, two circuit boards (51,52) are defined to mate with said first mating face 251 and the second mating face 252. As the first mating face 251 and the second mating face 252 staggered in the mating direction, said boards (51, 52) linked by connector 1 can be located on the mating faces (251,252) spreadably, so that the total height of board mounting profile can be improved.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A board to board connector, comprising:

a substantially flat and horizontal insulating housing having a first mating portion located on a first level, and a second mating portion located on a second level which is vertically offset from the first level, a bending portion interconnecting the first mating portion and the second mating portion;

a first mating face defined on a first surface of the first mating portion and a second mating face defined on a second surface opposite the first surface in a vertical direction, on the second mating portion; and a plurality of terminals, each spanning the first mating portion, the bending portion and the second mating portion, and having a first elastic-end and a second elastic-end corresponding to the first mating face and the second mating face respectively.

2. The board to board connector as claimed in claim 1, wherein said bending portion retains the terminals to the housing.

3. The board to board connector as claimed in claim 1, wherein a plurality of slots are formed in the first mating portion, and said first elastic-end protrudes through said slots.

4. The board to board connector as claimed in claim 3, wherein said board to board connector further includes a removable cover attached to the insulating housing further secures the terminals to the housing.

5. The board to board connector as claimed in claim 4, wherein a first base face formed on the first mating portion vertically opposite the first mating face, and a second base face formed on the second mating portion vertically opposite the second mating face, positioning portions are defined on both of the first and second mating portions.

6. The board to board connector as claimed in claim 5, wherein each of said terminals further defines an engaging portion between the first elastic-end and the second elastic-end, and a opening is formed on the engaging portion, and a corresponding protrusion is defined on the insulating housing.

7. An electrical connector comprising:

a substantially flat and horizontal insulative housing defining a retention base as well as first and second mating regions located on opposite sides of the retention base along a horizontal direction, said first mating region defining a first mating face in a first vertical direction perpendicular to said horizontal direction and said second mating region defining a second mating face in a second vertical direction opposite to the first vertical direction and perpendicular to said horizontal direction;

a plurality of contacts disposed upon the housing, each of said contacts defining a retaining section securely mounted to the retention base and corresponding first and second mating sections extending in opposite directions from the retaining section to the first and second mating regions, respectively; wherein said first mating region is vertically offset from the second mating region; wherein a first mating face defined on a first surface of the first mating region and a second mating face defined on a second surface opposite the first surface in a vertical direction, on the second mating region.

8. The electrical connector as claimed in claim 7, wherein said first mating region defines a plurality of passageways extending therethrough in the vertical direction, and the contacts are assembled to the housing in said vertical direction on the second surface such that one of either the first and second mating section extends through the corresponding passageway to the first surface.

9. The board to board connector as claimed in claim 7, wherein said retaining section is securely sandwiched between a cover and the retention base of the housing.

10. The electrical connector as claimed in claim 9, wherein said cover is assembled to the retention base of the housing in the vertical direction.

11. The electrical connector as claimed in claim 9, wherein the retaining section defines a hole, and one of said cover and said retention base of the housing defines a protrusion extending through said hole.

12. The electrical connector as claimed in claim 7, wherein said first mating region is further equipped with at least one mounting post extending from a face vertically opposite said first mating face.

13. The electrical connector as claimed in claim 12, wherein said contacts are assembled to the housing in said first vertical direction.

14. A board to board connector comprising:

an insulative housing defining opposite first and second mating regions in a horizontal direction, said first mating region defining a first mating face, said second mating region defining a second mating face vertically opposite to said first mating face; and a plurality of contacts assembled to the housing, each of said contacts unitarily including opposite first and second mating portions, said first mating portion extending over the first mating region and beyond to the first mating face in a first vertical direction, said second mating portion extending over the second mating region to the second mating face in a second vertical direction; wherein the first mating region is offset from the second mating region in the vertical direction.

15. The board to board connector as claimed in claim 14, wherein each of said contacts is vertically assembled to the housing.

16. The board to board connector as claimed in claim 14, wherein the first mating region further defines a mounting face vertically opposite to the first mating face.

17. The board to board connector as claimed in claim 16, wherein said first mating region further includes a mounting post extending from the mounting face.

18. The board to board connector as claimed in claim 17, wherein each of said contacts is assembled to the housing by a cover vertically attached to the housing.

19. The board to board connector as claimed in claim 17, wherein said second mating region further includes another mounting face vertically opposite the second mating face with another mounting post extending from said another mounting face.

* * * * *